US005711164A

United States Patent [19]

Slack

[11] Patent Number: 5,711,164

[45] Date of Patent: Jan. 27, 1998

[54] PORTABLE COOLER USING $CO_2$ FOR TEMPORARY COOLING

[76] Inventor: Patricia M. Slack, 15325 Regatta Way, Corona, Calif. 92530

[21] Appl. No.: 738,394

[22] Filed: Oct. 25, 1996

[51] Int. Cl.[6] ..... F25D 13/08; F25D 9/00

[52] U.S. Cl. ..... 62/457.9; 62/237; 62/401; 62/457.7

[58] Field of Search ..... 62/457.9, 457.7, 62/457.1, 457.3, 457.4, 371, 60, 86, 237, 401

[56] References Cited

U.S. PATENT DOCUMENTS

| | | | |
|---|---|---|---|
| 2,900,808 | 8/1959 | Wang | 62/457.9 |
| 3,148,515 | 9/1964 | Jentis et al. | 62/457.9 |
| 3,633,381 | 1/1972 | Haaf et al. | 62/222 |
| 3,665,728 | 5/1972 | Stoller | 62/320 |
| 4,058,384 | 11/1977 | Keefe | 62/457.9 |
| 4,766,740 | 8/1988 | Bradley et al. | 62/384 |
| 5,115,940 | 5/1992 | Friedman | 220/737 |
| 5,337,579 | 8/1994 | Saia et al. | 62/239 |
| 5,400,610 | 3/1995 | Macedo | 62/130 |
| 5,555,740 | 9/1996 | Stevenson | 62/293 |

*Primary Examiner*—William C. Doerrler
*Attorney, Agent, or Firm*—Willie Krawitz

[57] ABSTRACT

A portable cooler is provided including a plastic bag or container with inflatable sidewalls into which are placed items for cooling, such as infant feeding bottles, food, soft drinks, etc. Prior to using these items, the sidewalls of the bag are inflated with $CO_2$ gas, which upon expansion, sufficiently cools the interior of the bag, and chills the food. The plastic bag may also contain a frozen gel package to provide temporary cooling prior to use, and augment cooling by the $CO_2$. In a similar manner, cooling may be provided using a relatively stiff container having hollow sidewalls and/or a bottom into which may be expanded $CO_2$ gas to provide cooling prior to use. A frozen gel package may be placed inside the container or in the top portion of the container to augment $CO_2$ gas cooling. The same technique of cooling may also be accomplished using the expansion of $CO_2$ gas into the sidewalls of a thermos container.

6 Claims, 1 Drawing Sheet

FIG. 1
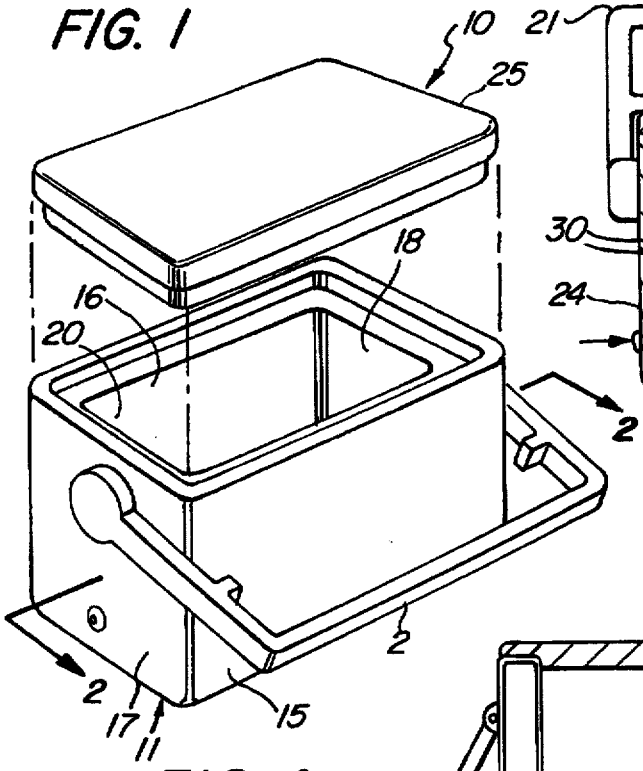
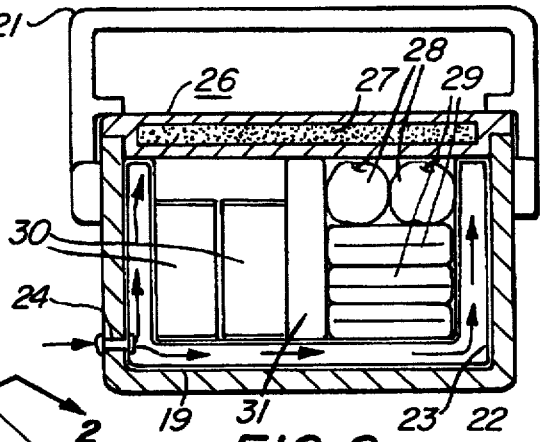
FIG. 2
FIG. 3
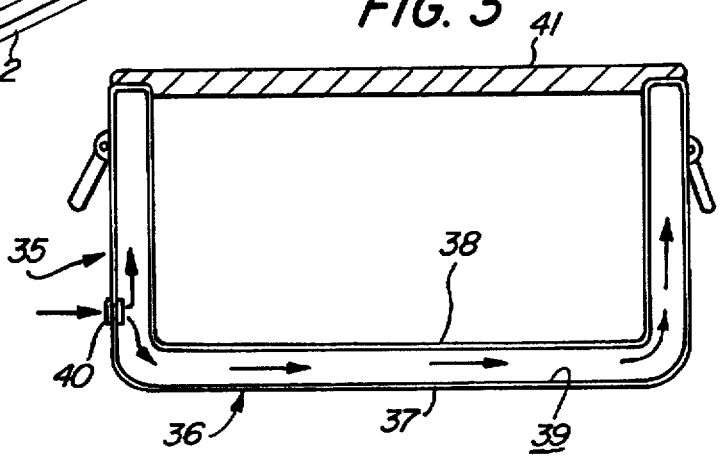
FIG. 4
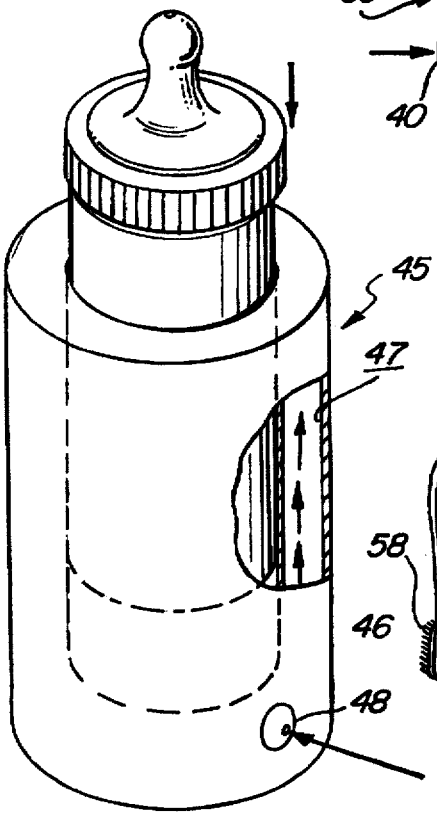
FIG. 5
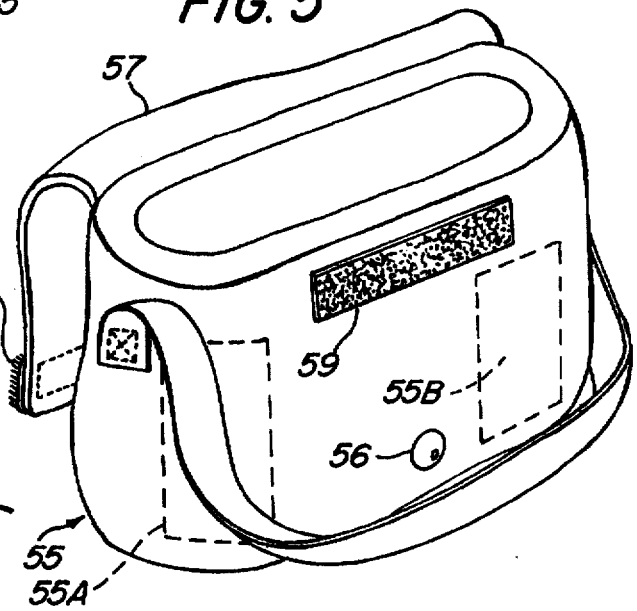

PORTABLE COOLER USING $CO_2$ FOR TEMPORARY COOLING

BACKGROUND OF THE INVENTION

This invention relates to a new and improved apparatus and method for cooling the interior of portable containers for the purpose of chilling food contained therein prior to use. Frequently, many types of food in portable containers do not require short term refrigeration in order to maintain edible qualities, although cooling would be desirable to improve the food taste. Typical examples would be canned drinks, sandwiches, fruit, vegetables, canned foods, baby foods such as juice, etc.

Many portable food containers such as picnic hampers have built-in areas into which frozen gel packages may be inserted to maintain a modicum of chilling for reasonably long periods of time. However, picnic and food hampers tend to be weighty and cumbersome, and it would be preferred to provide light-weight containers in which the food could be cooled quickly just prior to use, particularly where food cooling for say three to six hours is not essential for maintaining particular types of foods in a fresh state. Also it would be desirable to increase the amount of cooling in typical picnic and food hampers which would increase the cooling of foods prior to use but also to augment pre-existing cooling by frozen gel packs which are contained inside these containers or are mounted within the side walls or tops of the containers.

THE INVENTION

According to the invention, there is provided an apparatus and method for cooling food items therein, comprising a container including sidewall spaces, an inlet port for introducing and retaining an expandable gas into the spaces. When the gas expands, sufficient cooling is imparted to the spaces and the interior of the apparatus for cooling the food, and for the continued transmission of cooling of the interior from the spaces to maintain cooling effects. $CO_2$ is the expansion gas which is preferably used for cooling the container for its obvious properties of being readily available, inexpensive and non toxic.

Typical containers which may be employed in this invention include plastic film packages, thermos containers, and, picnic or food hampers, having thick, spaced-apart sidewalls into which the cooling gas may be introduced and retained until the cooling effect has dissipated.

If desired, a frozen gel package may be positioned in the interior of the container or between the container sidewalls to provide preliminary cooling of the expanding gas and to improve the cooling effect of the gas when present.

BRIEF DESCRIPTION OF THE DRAWINGS

FIG. 1 is a perspective view of a container, partly exploded, showing one form of container which may be employed to effect use of an expanding gas to cool the interior and food therein;

FIG. 2 is a cross section view in side elevation of the container, taken along lines 2—2 of FIG. 1;

FIG. 3 is a cross section view in side elevation of a container similar to FIG. 1;

FIG. 4 is a perspective view, partly in section showing a thermos type of container useful for cooling any soft drink, beer, infant's juice bottle; and, FIG. 5 is a perspective view of a film container shaped as a handbag useful for cooling food contents therein.

DESCRIPTION OF THE PREFERRED EMBODIMENTS

One form of a portable cooler 10 of this invention is shown in FIGS. 1 and 2, and comprises a container 11 constructed of an outer solid foam plastic material, defining longitudinal walls 15 and 16, end walls 17 and 18, and a floor 19, the walls and floor defining an interior 20; a carrying handle 21 is mounted on each of the end walls. An inner, gas impervious flexible heavy gauge (e.g. about 10 mils thick) plastic sheet 22 is formed and subsequently closed by sonic or heat welding, or by adhesives, to define a hollow portion 23 for containing an expanding gas, and the plastic sheet is configured to seat within the container 11. The plastic sheet may have a metallized coat on its exterior side to reflect cold into the container.

As shown in FIG. 2, a two way valve 24 is mounted within the end wall 17 and extends into the hollow portion 23 of the plastic sheet 22. When $CO_2$ gas is fed through the valve and into the hollow portion 23, it will expand and cool the interior 20 of the container 11.

A lid portion 25 is configured to interfit onto the top of the container 11, and is typically constructed of a plastic foam insulator material similar to that of the outer portion of the container; the lid defines a hollow portion 26 of the lid for containing a frozen gel package 27 to produce medium cooling over a lengthy period of time.

Food items such as fruit 28, sandwiches 29 and, canned soft drinks 30 are stored within the interior of the container, and if desired, a frozen gel package 31 may be used to augment the cooling effect of the frozen gel package 27.

Another embodiment of a portable cooler 35 is illustrated in FIG. 3, and comprises a container 36 constructed of stiff or flexible sheet or insulating foam sheet providing an outer bottom and wall portion 37, a corresponding inner bottom and wall portion 38, and a hollow space 39 defined between the outer and inner portions. A valve 40, similar to the valve 24 is mounted into the outer wall portion 37, and $CO_2$ gas is fed through the valve and expands into hollow space 39 for cooling purposes. A top portion 41 is configured to seat onto the top of the container 36, and is constructed of foam or thick gauge plastic material similar to that of FIGS. 1 and 2. Unlike the portable cooler 10, top portion 41 does not contain a frozen gel package; the cooler 35 is lighter than its counterpart in FIGS. 1 and 2.

Another embodiment of this invention is shown in FIG. 4, and comprises an elongate thermos shaped holder 45 comprising an outer, foam, plastic or metal container portion 46 defining an inner circumferential dead air space portion 47. A valve 48 is mounted within the outer container portion 46 which leads into the dead air space portion 47. As in the other embodiments, intake of $CO_2$ gas through the valve 48 results in expansion of the gas and cooling the contents of the thermos holder 45, which in this case is a baby bottle 49; obviously, other food items can be contained within the holder, such as soft drink cans, etc.

Another embodiment of this invention is shown in FIG. 5, and comprises a diaper bag having a rigid or resilient foam plastic container portion 55 providing diaper bag's baby bottle outer pockets 55A, 55B (shown in dotted designation) which are used to contain baby bottles. An intake valve 56 leads into the dead air spaces (not shown) adjacent the pockets, and enables $CO_2$ gas to be fed therethrough, expand and cool bottles held in the pockets. A top flap 57 is secured to the container and is closed by VELCRO™ strips 58 and 59; the flap closure will secure and insulate the bottles; a carrying strap 60 is also provided.

The various embodiments of this invention enable food cooling by expanding $CO_2$ and/or other similar gases into hollow sidewalls of portable food containers to obtain rapid cooling prior to use to render the food more appetizing, and to reduce the possibility of food deterioration during the cooling period.

I claim:

1. An insulated food container comprising, rigid sidewalls and bottom, an insulated cover element for mounting onto the container, a hollow, flexible plastic film being configured for positioning within the container and adjacent the sidewalls and bottom of the container, and a valve element mounted within and extending through a sidewall and into the plastic film for receiving an expanding and cooling gas, the sidewalls and bottom being arranged and constructed to contain the expanding gas in the plastic film, and to transmit cooling effects from the expanding gas through a sidewall and into the plastic film to cool food contained within the container.

2. The food container of claim 1, in which the hollow sidewall comprises foam material.

3. The food container of claim 1, in which the cover element includes a frozen gel package.

4. A method of cooling a portable, insulated food container, comprising providing a container portion and a cover element for insertable mounting thereon, the container having rigid, food containing sidewalls and a bottom portion, a hollow portion defined between the sidewalls and bottom portion, a heavy gauge plastic film being defined along and within the sidewalls and bottom portion of the container and having a hollow configuration, the method comprising inserting a valve into a sidewall of the container, extending the valve through the sidewall of the container into the plastic film, feeding $CO_2$ gas through the valve, expanding and thereby cooling the gas into the plastic film, and transmitting cooling effects produced by the expanding gas from the plastic film to food within the container.

5. The method of claim 4, in which the hollow sidewall and bottom comprise plastic foam material.

6. The method of claim 4, in which the cover element includes a frozen gel package.

* * * * *